United States Patent [19]

Rundo

[11] Patent Number: 4,499,703

[45] Date of Patent: Feb. 19, 1985

[54] METHOD OF RETRO-FITTING WINDOWS

[75] Inventor: John R. Rundo, Strongsville, Ohio

[73] Assignee: The BF Goodrich Company, New York, N.Y.

[21] Appl. No.: 348,907

[22] Filed: Feb. 16, 1982

[51] Int. Cl.[3] ..... E04B 21/00

[52] U.S. Cl. ..... 52/746; 52/172; 52/203; 156/71; 156/109

[58] Field of Search ..... 52/202, 203, 309.16, 52/790, 171, 172, 746, 741; 49/62; 156/108, 71, 109

[56] References Cited

U.S. PATENT DOCUMENTS

| | | | |
|---|---|---|---|
| 2,052,244 | 8/1936 | Pertz | 52/790 |
| 2,098,127 | 11/1937 | Auger | 52/203 |
| 2,569,941 | 10/1951 | Mastrangelo et al. | 52/202 |
| 3,573,149 | 3/1971 | Tibble | 52/790 |
| 3,919,452 | 11/1975 | Ettre et al. | 52/304 |
| 3,971,178 | 7/1976 | Mazzoni et al. | 52/203 |
| 4,121,394 | 10/1978 | Brooks | 52/203 |
| 4,194,331 | 3/1980 | Gingle | 52/203 |
| 4,208,849 | 6/1980 | Lamb | 52/203 |
| 4,357,187 | 11/1982 | Stanley | 52/203 |

FOREIGN PATENT DOCUMENTS

| | | | |
|---|---|---|---|
| 0747173 | 11/1966 | Canada | 52/203 |
| 2824896 | 12/1979 | Fed. Rep. of Germany | 52/203 |
| 2041434 | 9/1980 | United Kingdom | 52/790 |
| 2044334 | 10/1980 | United Kingdom | 52/203 |

*Primary Examiner*—John E. Murtagh

*Attorney, Agent, or Firm*—Joseph Januszkiewicz

[57] ABSTRACT

The method of retro-fitting a window from a single windowpane into a double windowpane wherein an existing windowpane in a sash is measured for the purpose of cutting a glass pane to the precise dimensions or slightly less than that of the exposed glass in the existing windowpane. Such glass pane has a sealant strip applied to the entire perimeter thereof. The strip can also be initially applied existing window pane. The glass and strip are then placed onto the existing windowpane to secure such glass pane to the windowpane and sash. Thereafter a stop is placed around the entire perimeter of the glass pane and is secured to the sash.

1 Claim, 12 Drawing Figures

METHOD OF RETRO-FITTING WINDOWS

BACKGROUND OF THE INVENTION

This invention relates to the construction of double insulated windows as well as to retrofitting of an existing single pane or window into a dual or multiple insulated panes.

A large percentage of the energy lost through the walls of a building in the winter is lost through the window panes. Accordingly, it is desirable to install insulated or thermal windows where possible. Because of the present cost it is extremely expensive to fabricate a double pane insulated window particularly of large dimensions and then install them at remote locations. The present invention has the unique ability to permit the installation of a single pane and thence with the application of a sealant spacer at the site permits the further installation of a second pane immediate over the first pane or window to provide a double insulated window. This is particularly significant in industrial and office structures.

Another method of dealing with the problem of heat loss through windows is to replace existing panes with insulated panes or the placement of a storm window thereon to provide thermal insulation of windows which cuts down on the transmission of heat to a substantial extent. The use of a supplemental window sash placed on the exterior of the conventional window sash during the winter months has the disadvantage of requiring annual removal with the accompanying interference with ventilation at the end of a season as well as at the beginning of the cold season. Further such supplemental windows are impractical for the larger home panes or industrial and office structural panes.

The present invention overcomes these disadvantages of conversion or retrofitting by providing a permanent dual pane installation without requiring removal of existing panes. The present invention is particularly useful in industrial and office structures and even in high rise or large type apartment dwellings which employ large picture windows. The present invention permits the economic retro-fitting of existing panes by adding a pane into the existing pane with proper spacing and sealing means to insure a sealed insulated space therebetween. The present invention permits this economical and aesthetic method for installation of insulated panes even where access to the exterior panes is virtually impossible.

SUMMARY OF THE INVENTION

The present invention contemplates a novel method of fabricating dual pane windows as well as retro-fitting windows wherein a single existing windowpane located within an existing sash of a structural building has a deformable sealant strip with a spacer therein applied to the entire perimeter of such windowpane, followed by the placing of a newly cut glass pane onto the strip into firm contact therewith and thence locate either a stop around the entire perimeter of the newly located glass pane or to both perimeters to firmly secure said windowpane and glass pane into intimate contact with the sealant strip. Alternatively, the sealant strip may be initially installed on the glass pane and thence the glass pane and sealant strip may be applied as a unit to the existing windowpane. Such retrofitting and fabricating of dual pane windows enhances the ability of the windowpanes to resist external forces of displacement while permitting conversion of large windowpanes into double windowpanes at a greatly reduced cost while saving considerably in energy loss.

DESCRIPTION OF THE PREFERRED EMBODIMENT

Figure 1:
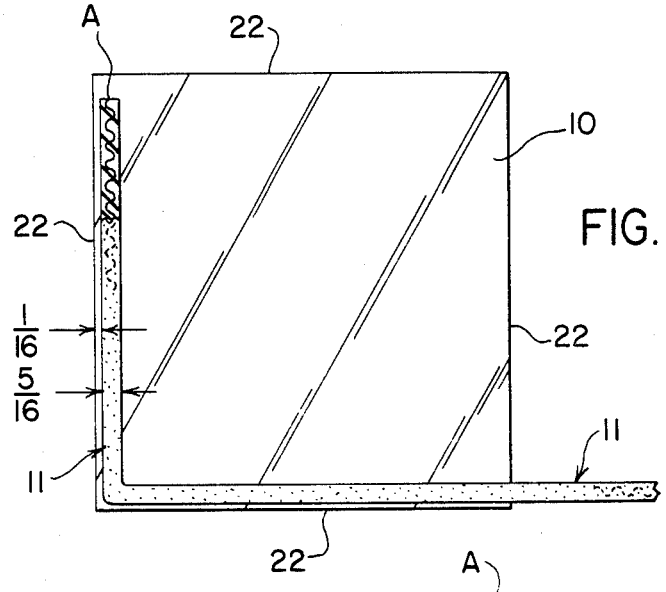
FIG. 1 is a plan view of a windowpane with a sealant strip being applied to the perimeter thereof.
Figure 2:
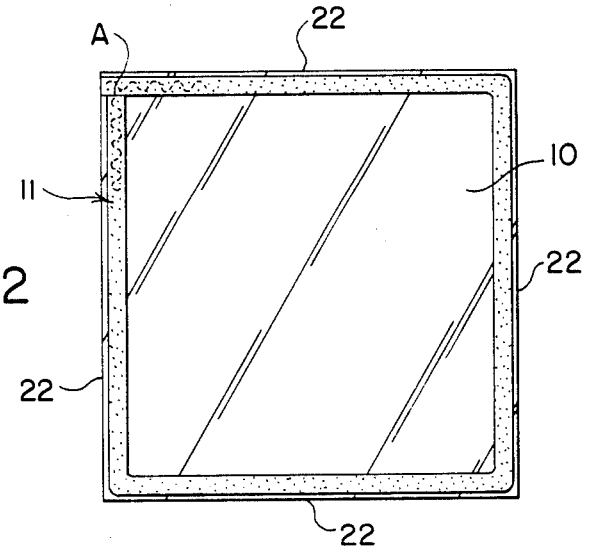
FIG. 2 is a plan view of a windowpane with the sealant strip applied fully around the perimeter thereof prior to its installation onto a window.

Referring now to the drawings wherein like reference characters designate like or corresponding parts throughout the several views, there is shown in FIG. 1 a window pane or rectangular plate of glass 10.

Figure 10:
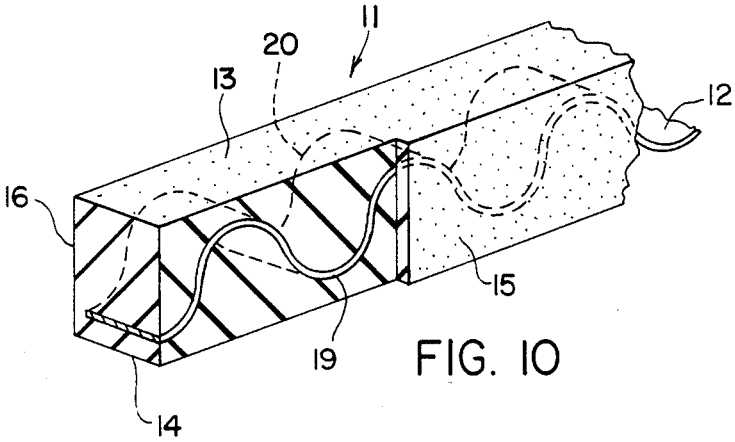
FIG. 10 is an isometric view of the sealant strip with a portion of the sealant material broken away showing an embedded spacer therein.

A sealant strip 11 (shown in FIG. 10) is an elongated body of deformable sealant fully enveloping and having enveloped therein a spacer means 12 extending longitudinally of strip 11. The spacer means 12 is in the form of an undulating ribbon of rigid material such as aluminum. As seen in FIG. 10, the deformable sealant material that encompasses spacer means 12 is in intimate contact with all of the surfaces and edges of the spacer means 12. The strip 11, as disclosed in FIG. 10 has an upper surface 13, a lower surface 14 and two parallel side surfaces 15 and 16.

The geometry of the spacer means 12 presents a sine curve configuration with side edges 19 and 20 closely adjacent side surfaces 15 and 16 respectively. With such geometry of spacer means 12, it is capable of resisting compressive forces exerted on it in a plane which is normal to the parallel side surfaces 15 and 16 and the side edges 19 and 20. The spacer means 12 would not be able to resist compressive forces on its surfaces 13 and 14 to any substantial extent but would on surfaces 15 and 16. As seen in FIG. 10, the sealant that extends beyond the edges 19 and 20 is sufficient to maintain a continuous sealing interface between double glazed windowpanes to be described and insufficient to permit a buldging out of the sealant or a disfiguring as a "ballooning" of the sealant in the area between the spaced window panes. As an example of the amount of extra sealant beyond the side edges 19 and 20 of spacer means 12 of strip 11, the thickness of the sealant extending beyond the spacer means edges may be approximately $\frac{1}{8}$ of an inch.

Figure 12:
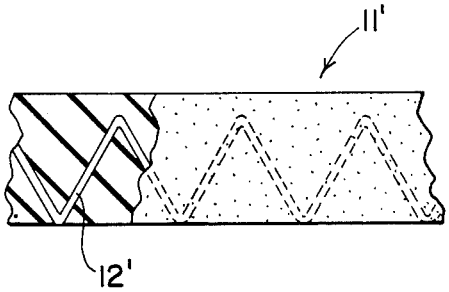
FIG. 12 is a fragmentary cross-sectional view of a Swiggle Strip showing a modified form of spacer.

A modification of the sealant strip 11 is shown in FIG. 12 wherein the strip 11' is an elongated body of deformable sealant having embedded therein a spacer means 12'. Spacer means 12' is in the form of a pleated or accordian pleated ribbon of rigid material such as a plastic or metal. The ribbon or spacer means 12' extends for the full length of the sealant strip 11'. The deformable sealant material as in the first embodiment contains a desiccant to remove moisture.

Deformable as used herein contemplates the property in an uncured state and has the inability to resist the compressive forces exerted thereon without deforming and includes thermoplastic thermosetting, polysulfide polymers, urethane polymers, acrylic polymers, styrene-butadiene polymers, and thermoplastic-thermosetting materials even though upon curing such materials are capable of resisting such forces. The preferred sealant is one which is initially incapable of resisting the compressive forces exerted upon it, and remains so throughout its useful life. The sealant generally includes a desiccant which removes moisture from the air space that the sealant incloses.

The sealant strip 11 is applied far enough away (generally 1/16 of an inch) from the peripheral edges 22 of the window pane 10 to allow for the expansion of the strip 11 when compressed. This will insure the sealant strip 11 will be flush with the glass edges to be described when the unit is completed. The strip 11 is preferably begun at one corner of the pane 10 at a point A to allow for the thickness of the strip 11 and a small clearance space for expansion (which in the example is 1/16 of an inch). As the sealant strip 11 is applied along the edge 22 of pane 10, the 1/16 of an inch clearance is maintained even as the strip 11 is bent to form the corners. As the strip is applied to the pane 10 completely around the edge of the glass, it is cut off at right angles to but seals the cut off portion to that portion of the strip at the starting edge A so that the materials of the strip adhere to itself and forms a seal. The sealant strip's 11 outer surface is very tacky and adheres on contact. As used herein sealant includes the adhesive quality that is necessary to adhere the panes of glass together and to the adjacent mounting sash.

Figure 3:
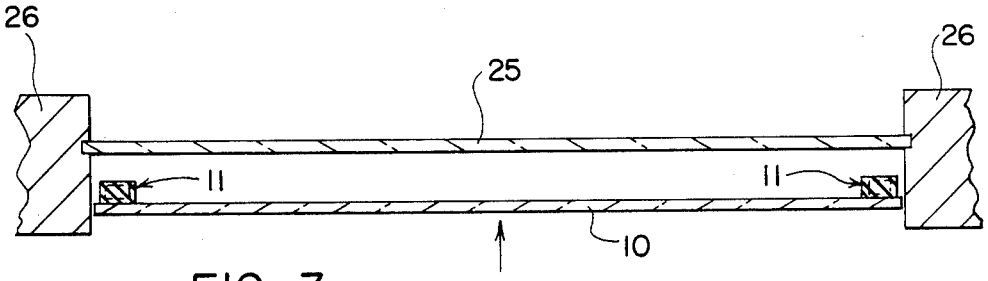
FIG. 3 is a cross-sectional view of a window with a windowpane and its accompanying sealant strip being applied thereto.
Figure 4:
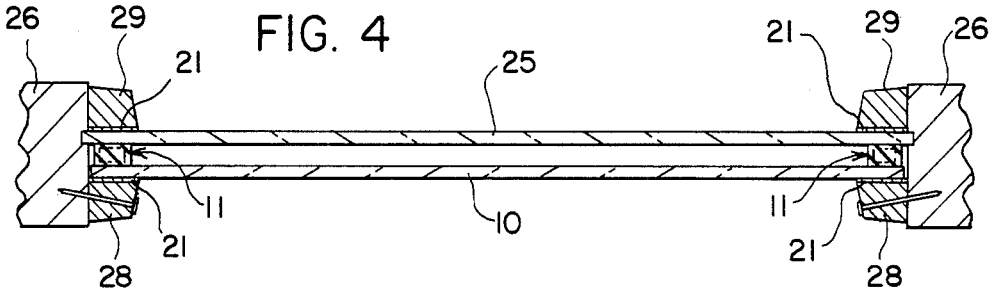
FIG. 4 is a cross-sectional view of a window with a windowpane and its sealant strip located thereon with a decorative strip or stop attached to the window sash.

With the strip 11 fully encompassing the edge 22 of window pane 10, the window pane 10 is then moved into position where it is in alignment with an existing window pane 25 (FIG. 3) that is already in an existing sash or support 26. FIG. 3 shows the respective lateral side supports 26 which may alternatively be in the form of sashes. The sealant has the adhesive quality such that upon contact of the strip 11 with the pane 25 a firm bond is effected that does not permit the sliding of pane 10 relative to pane 25. Stops or decorative strips 28 are located around the perimeter of the exterior surface of pane 10 and abuttingly engages the sash or support 26 and are secured thereto by suitable means. Preferably stops 28 are larger in width than the sealant strip 11 thereby completely hiding the sealant strip 11 from view.

A second set of stops or decorative strips 29 are located around the perimeter of the exterior surface of window pane 10. The described method of installing the double glass windows or panes preferably include shims such as silicone strips 21 or cushion the fixed stops 28 and 29. The sealant strip 11 is of lesser width than the respective stops 28 and 29 to provide a shadow box effect as well as to protect the sealant strip from the sun's ultra violet rays. Such described method can be used for original installations or in the retrofitting of existing window installations.

Figure 5:
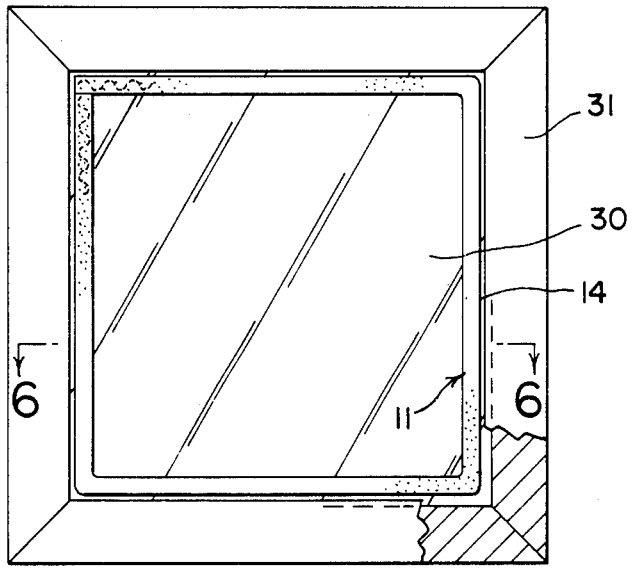
FIG. 5 is a front elevational view of a window with a sealant strip applied around the entire perimeter of the pane.
Figure 6:
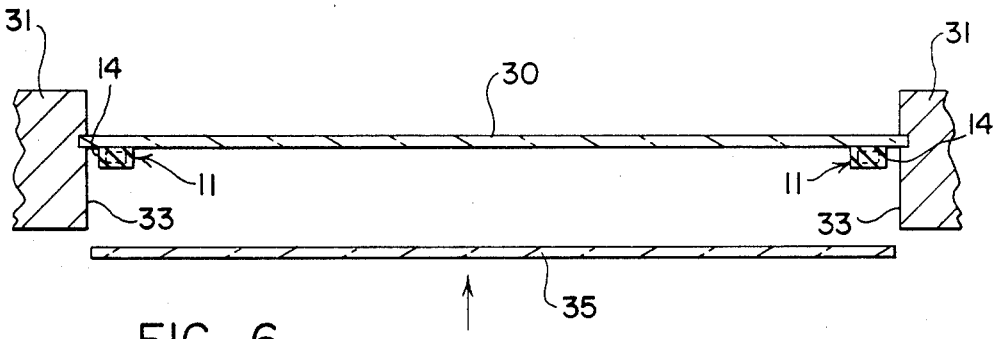
FIG. 6 is a cross-sectional view in plan of a window as shown in FIG. 5 with a sealant strip applied to the perimeter of a window pane and a window pane being applied thereto.

A modification of the above described method is shown in FIGS. 5 and 6 wherein a windowpane 30 is fully enclosed by sashes 31 or other suitable frame supports. The sealant strip 11 is applied around the outer perimeter of the windowpane 30 such that there is a small clearance space between the side edge 33 of the sash 31 and the side edge 14 of strip 11. As in the first embodiment, the strip 11 is begun at one corner of the pane 30 to allow for the thickness of the strip 11 as it is positioned on around the perimeter and then brought back to the point of beginning, while maintaining the clearance space. The 1/16" clearance space is maintained completely around the perimeter of the glass, even when bending the sealant strip to form the corners. This bending is substantially a ninety degree angle. A pane of glass 35, previously cut to the proper size is thence brought into alignment with the windowpane 30 and placed into abutting and bonding contact with the strip 11. The clearance space (which may have been on the order of 1/16") completely filled as the sealant flows out or expands when compressed by the placement of the pane 35 thereon. This insures that the sealant is flush with the glass edges when the unit is completed. Stops 28 and 29 with their shims as in the first embodiment are located around the perimeter of the windowpanes and the existing sash to insure structural support.

Figure 7:
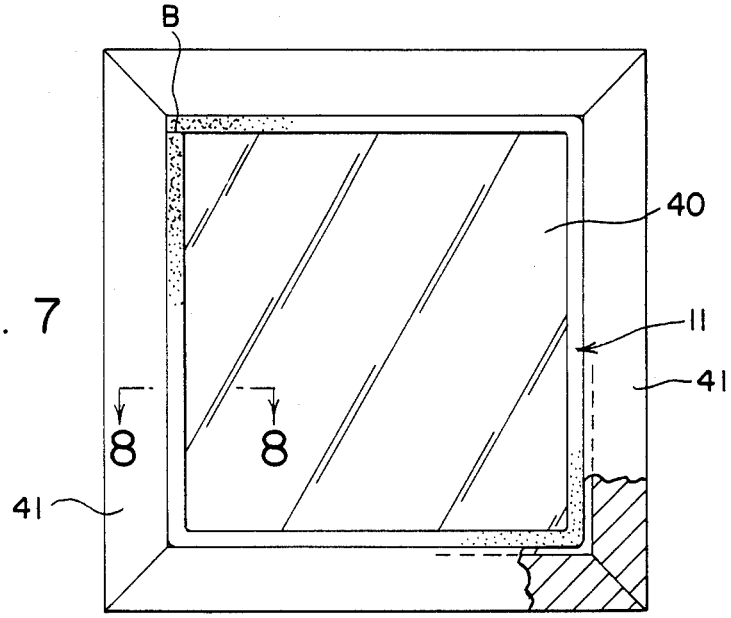
FIG. 7 is a front elevational view of a double pane window as fabricated in FIGS. 5 and 6 with a portion thereof broken away to show the sealant strip.
Figure 8:
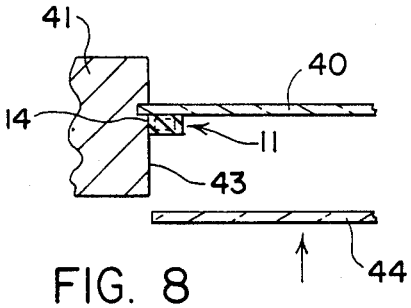
FIG. 8 is a fragmentary plan view of a modification of the fabrication of a double pane window as fabricated in FIGS. 5 through 7 wherein the sealant strip is applied to the perimeter of a window pane and sash prior to the placement of a windowpane thereon.
Figure 9:
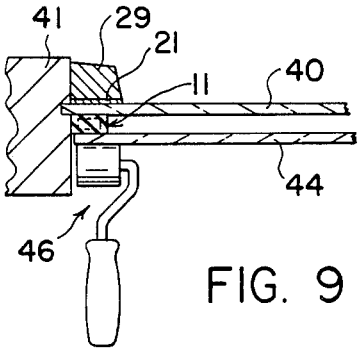
FIG. 9 is a fragmentary plan view of the double pane window showing in FIG. 8 with a roller being applied to the perimeter of the applied pane.

A further modification of the above described method is shown in FIG. 7 wherein a windowpane 40 is fully enclosed by sashes 41 as in the second described embodiment. The sealant adhesive strip 11 is then applied around the outer periphery of the windowpane 40 such that its outer surface 14 comes into abutting contact with the inner adjacent surface 43 of the sashes 41. As in the first described embodiment, the strip 11 is begun preferably at one corner B of the pane 40 to allow for the thickness of the strip 11 as the strip 11 is doubled back on completion of the laying of the strip 11 around the peripheral surface of the pane 30. A second pane of glass 44, previously cut to the proper dimension of the existing size of windowpane 40, is thence brought into alignment with the windowpane 40 and placed into abutting contact with the strip 11. The tape or strip 11 and the second windowpane or pane 44 are compressed to assure a proper bonding which can be done by using a roller 46. As in the first embodiment stops are located around the perimeter of the windowpanes and the existing sash or sill 41 to ensure structural soundness. In lieu of a fixed stop a bead of a suitable glaze may be applied to the perimeter of the glass and adjacent sash or sill 41. The application of the strip 11 into firm contact with the windowpane and sash has the additional surprising benefit of enhancing the rigidity of strength of the outermost window to prevent the accidental blowing out of single pane windows as has occurred in large office buildings.

Figure 11:
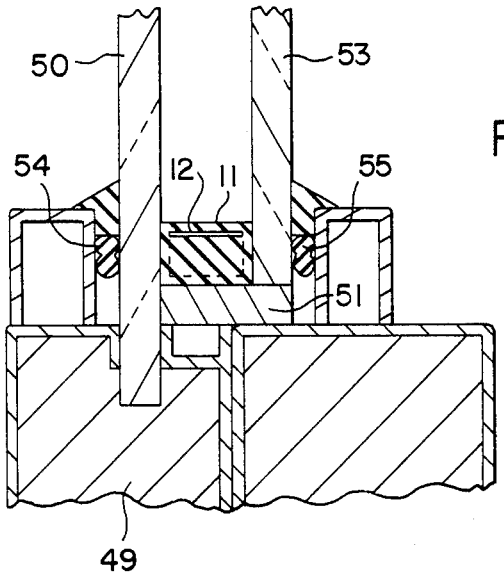
FIG. 11 is a cross-sectional view of a dual pane window showing the construction thereof.

FIG. 11 shows a new installation wherein a window or glass pane 50 is suitably seated in an existing support 49 a setting block or blocks 51 is positioned along the bottom surface adjacent to interior surface of the glass pane 50. A sealant strip 11' or 11 is applied to the peripheral interior surface of the glass pane 50 such that the spacer 12 or 12' has its width in compression by the glass panes. A second pane 53 is then placed into abutting contact with the first pane 50. Shims 54 and 55 are then applied to the peripheral of the respective glass panes, after which stops such as aluminum Ushaped members are suitably secured to the support 49. Sufficient pressure is exerted against the panes to assure a firm installation before the stops are secured to the supports 49.

It will be apparent that, although a specific embodiment and certain modifications of the invention have been described in detail, the invention is not limited to the specifically illustrated and described constructions since variations may be made without departing from the principals of the inventions.

I claim:

1. The method of retro-fitting a single windowpane mounted in a frame to a double windowpane comprising the steps of applying a deformable tacky adhesive sealant strip containing a desiccant with an embedded spacer therein to the glass surface of said single windowpane along the entire perimeter of said single windowpane, said embedded spacer is a corrugated ribbon with spacer side edges, said deformable strip is applied to said glass surface with one of said side edges adjacent to said glass surface to resist any compressive forces thereon, cutting a glass pane to the measured dimensions of the said single windowpane, placing said cut glass pane onto the sealant strip to abuttingly engage said strip around said perimeter wherein said strip of sealant is applied to said glass surface of said windowpane and into abutting contact with sash frame of said single windowpane as pressure is applied to said cut glass as said glass abuts said sealant strip, and locating a stop around the entire perimeter of said cut glass wherein said stop is secured to said frame of said windowpane and abuttingly engages said cut glass.

* * * * *

UNITED STATES PATENT AND TRADEMARK OFFICE

CERTIFICATE OF CORRECTION

PATENT NO. : 4,499,703

DATED : February 19, 1985

INVENTOR(S) : JOHN R. RUNDO

It is certified that error appears in the above-identified patent and that said Letters Patent are hereby corrected as shown below:

In Claim 1, column 6, line 3, after the phrase "mounted in a" insert --sash--; Claim 1, column 6, line 21, after the phrase "secured to said" insert --sash--.

Signed and Sealed this

*Second* Day of *July 1985*

[SEAL]

*Attest:*

DONALD J. QUIGG

*Attesting Officer*

*Acting Commissioner of Patents and Trademarks*